US008798897B2

(12) United States Patent
Fei et al.

(10) Patent No.: US 8,798,897 B2
(45) Date of Patent: Aug. 5, 2014

(54) REAL-TIME TRAFFIC ANALYSIS THROUGH INTEGRATION OF ROAD TRAFFIC PREDICTION AND TRAFFIC MICROSIMULATION MODELS

(75) Inventors: Xiang Fei, Beijing (CN); Laura Wynter, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 863 days.

(21) Appl. No.: 12/917,086

(22) Filed: Nov. 1, 2010

(65) Prior Publication Data

US 2012/0109506 A1 May 3, 2012

(51) Int. Cl.
*G08G 1/00* (2006.01)

(52) U.S. Cl.
USPC ..... 701/118

(58) Field of Classification Search
None
See application file for complete search history.

(56) References Cited

U.S. PATENT DOCUMENTS

| | | | | |
|---|---|---|---|---|
| 5,646,853 | A * | 7/1997 | Takahashi et al. | 455/456.5 |
| 7,236,881 | B2 | 6/2007 | Liu et al. | |
| 7,363,144 | B2 | 4/2008 | Liu et al. | |
| 2008/0069000 | A1 | 3/2008 | Muck | |
| 2008/0175161 | A1 | 7/2008 | Amemiya et al. | |
| 2009/0099760 | A1 | 4/2009 | Lederman et al. | |
| 2010/0063715 | A1 | 3/2010 | Wynter et al. | |

OTHER PUBLICATIONS

Barcelo, J., et al., "Online Microscopic Traffic Simulation Supports Real-time Traffic-management Strategies", Siam News, 2007, vol. 40, No. 9.
Van Gasteren, et al., "The Binary Search Revisited", Educational Issues of Formal Methods Academic Press, 1996.
Jain, A.K., et al., "Data Clustering: a Review", ACM Computing Surveys, Sep. 1999, vol. 3, No. 31.
Ziliaskopoulos, A., "A Linear Programming Model for the Single Destination System Optimum Dynamic Traffic Assignment Problem", Transportation Science, Feb. 2000, pp. 37-49, vol. 34, No. 1.
Born, G.H., "Gauss-Markov Theorem", http://ccar.colorado.edu/ASEN5070/Handouts/Gauss_Markov_2004.pdf, Dec. 8, 2004.
Gerstman, B., "Regression" in StatPrimer, http://www.sjsu.edu/faculty/gerstman/StatPrimer/regression.pdf, Mar. 4, 2004.
Lederman, R., et al., "Real-Time Traffic Estimation Using Data Expansion", Elsevier, Apr. 26, 2010Man, R., et al., "Real-Time Traffic Estimation Using Data Expansion", Elsevier, Apr. 26, 2010.

(Continued)

*Primary Examiner* — Thomas Tarcza
*Assistant Examiner* — Garrett Evans
(74) *Attorney, Agent, or Firm* — Scully, Scott, Murphy & Presser, P.C.; Daniel P. Morris, Esq.

(57) ABSTRACT

A system, method and computer program product for forecasting a vehicle traffic condition in a near future. The system comprises a traffic prediction tool, a turning percentage prediction module and a simulation tool. The traffic prediction tool estimates a traffic speed and volume in a traffic link. A traffic link refers to a portion of a traffic road where the traffic prediction tool is installed. The turning percentage prediction module estimates a turning percentage in the traffic link based on the estimated traffic speed and traffic volume. The simulation tool computes, based on the estimated turning percentage, the estimated traffic speed and the estimated traffic volume, an expected traffic volume in the traffic link.

21 Claims, 7 Drawing Sheets

(56) References Cited

OTHER PUBLICATIONS

Murphy, K.P., "Linear Regression", http://citeseerx.ist.psu.edu/viewdoc/similar?doi=10.1.1.121.3661, Mar. 13, 2007.

Williams, C.A., et al., "Mining Sequential Association Rules for Traveler Context Prediction", International Conference on Mobile and Ubiquitous Systems Proceedings of the 5th Annual International Conference on Mobile and Ubiquitous Systems: Computing, Networking, and Services, ICST (Institute for Computer Sciences, Social-Informatics and Telecommunications Engineering), 2008.

Alford, B., et al., "An Analysis of Various Spline Smoothing Techniques for Online Auctions", AMSC Interaction Team 689, Dec. 10, 2004.

Daganzo, C.F., "The Cell Transmission Model, Part II: Network Traffic", Transpn. Res.-B, 1995, pp. 79-93, vol. 29B, No. 2.

Hahn, K., "Lagrange Multiplier Method for finding Optimums", http://www.karlscalculus.org/pdf/lagrange.pdf, 2008.

Liao, L., et al., "Learning and Inferring Transportation Routines", Artificial Intelligence, Apr. 2007, pp. 311-331, vol. 171, Issue 5-6, Elsevier Science.

Newell, C.J., et al., "Appendix A.2: Statistical Trend Analysis Methods", Air Force Center for Environmental Excellence, AFCEE Monitoring and Remediation Optimization System Software, Version 2.2, Feb. 2007.

Williams, C.A., "A Data Mining Approach to Rapidly Learning Traveler Activity Patterns for Mobile Applications", Ph.D. Dissertation, Department of Computer Science, University of Illinois at Chicago, Apr. 2010.

* cited by examiner

Source Boundary Link

Destination Boundary Link

Ordinary Link

Merge Link

Diverge Link

REAL-TIME TRAFFIC ANALYSIS THROUGH INTEGRATION OF ROAD TRAFFIC PREDICTION AND TRAFFIC MICROSIMULATION MODELS

BACKGROUND

The present invention generally relates to a real-time vehicle traffic simulation. More particularly, the present invention relates to a system, method and computer program product for forecasting a vehicle traffic condition in a near future.

Traditional traffic management models are used for analyzing details of a road network (e.g., traffic signal timing, lane configurations and closures, and other aspects of a road network). J. Barceló, et al., "Online Microscopic Traffic Simulation Supports Real-time Traffic-management Strategies," SIAM News, Volume 40, Number 9, November 2007, wholly incorporated by reference as if set forth herein, describes a real-time traffic management model. A traffic management model is often also known as traffic microscopic simulation, traffic microsimulation, or traffic simulation program, because it emulates a traffic flow on a road network at a relatively fine, or micro, level of detail, e.g., a level of an individual vehicle movement.

Benefits of emulating the traffic flow on the traffic road network at this level of detail are numerous, as the emulation can be used to: minimizing congestion, minimizing travel time or delay, reducing emissions, etc. For example, if this emulation could provide information that is communicated in real-time to a vehicle driver about a possible congestion on a particular road, the driver may detour the particular road and use an alternative route to arrive his destination. Thus, the driver may be able to arrive at his/her destination on time.

However, tools for emulating of traffic have not been successfully applied to real-time traffic analysis for a number of reasons. One reason has to do with the computation time required by traffic emulation. In spite of advances in a computation power, the traffic microsimulation tools are not fast enough to be run in real-time and thus their output (e.g., the number of vehicles on a particular road route) could not have been used in a real-time setting. Another reason is that a physical communication network link installed between a traffic road and a traffic emulation tool was not stable. Thus, traffic emulation tools do not readily incorporate typical real-time traffic data (e.g., real-time traffic speed and volume).

SUMMARY OF THE INVENTION

The present invention is a system, method and computer program product for forecasting a vehicle traffic condition in a near future (e.g., 1 hour in advance).

In one embodiment, there is provided a system for forecasting a vehicle traffic condition in a near future. The system comprises a traffic prediction tool, a turning percentage prediction module and a simulation tool. One or more of the traffic prediction tool, the turning percentage prediction module and simulation tool is implemented in a computing system that comprises at least one processor and at least one memory device connected to the processor. The traffic prediction tool estimates a traffic speed and volume in a traffic link. A traffic link refers to a portion of a traffic road where the traffic prediction tool is installed. The turning percentage prediction module estimates a turning percentage in the traffic link based on the estimated traffic speed and traffic volume. The simulation tool computes, based on the estimated turning percentage, the estimated traffic speed and the estimated traffic volume, an expected traffic volume in the traffic link in the near future on the traffic link.

In a further embodiment, the turning percentage prediction module evaluates whether the traffic link is a congested regime. A congested regime has a traffic volume larger than a threshold. The turning percentage prediction module determines a link topology of the traffic link in response to determining that the traffic link is a congested regime. The determined link topology is one of: a diverge link, a merge link, an ordinary link, a source boundary link and a destination boundary link. The turning percentage prediction module computes the estimated turning percentage according to the determined link topology.

In a further embodiment, the turning percentage prediction module computes a historical turning percentage of the traffic link. The historical turning percentage represents an average of prior turning percentages in the traffic link. The turning percentage prediction module computes a weighted average turning percentage based on the historical turning percentage and a pre-determined weight assigned to the traffic link.

In a further embodiment, the simulation tool computes the expected traffic volume in the traffic link based on one or more of: the computed historical turning percentage of the traffic link and the weighted average turning percentage.

In a further embodiment, the turning percentage prediction module computes the estimated turning percentage of the traffic link in a free flow regime in response to determining that the traffic link is not a congested regime. A free flow regime has a traffic volume less than a threshold.

In a further embodiment, the simulation tool recommends to a user an alternative traffic management strategy based on the computed expected traffic volume and the incident occurrence.

In a further embodiment, the alternative traffic management strategy includes one or more of: detouring traffic in the traffic link through another traffic link, adjusting a traffic signal in the traffic link, adjusting a speed limit in the traffic link, and adjusting a fare of the traffic link.

BRIEF DESCRIPTION OF THE DRAWINGS

The accompanying drawings are included to provide a further understanding of the present invention, and are incorporated in and constitute a part of this specification.

DETAILED DESCRIPTION

Figure 1:
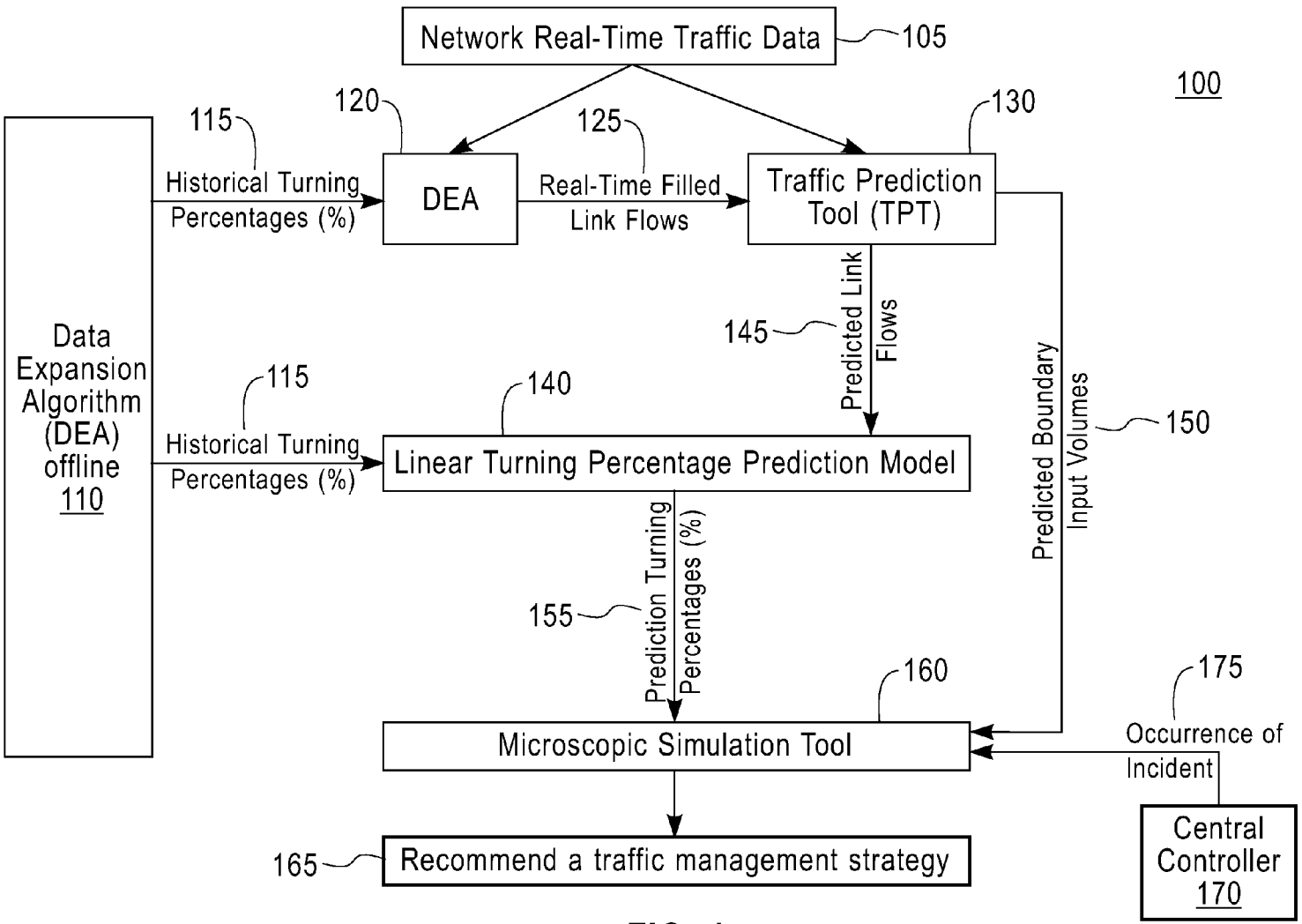
FIG. 1 illustrates a real-time traffic prediction system in one embodiment.

FIG. 1 illustrates a real-time vehicle traffic prediction system 100 that forecast a traffic condition, e.g., traffic vehicle volume (i.e., the number of traffic vehicles), traffic vehicle speed, etc., in a traffic link in a near future in one embodiment. A traffic link refers to a portion (e.g., one traffic lane whose length may be half mile) of a traffic road where a traffic prediction tool (TPT) 130 is installed. The real-time traffic prediction system 100 includes, but is not limited to, three main components: (i) a TPT 130 which generates predictions of traffic volumes and traffic speed in the traffic link in a near future (e.g., 1 hour ahead), (ii) a turning percentage prediction module 140, and (iii) a traffic microscopic simulation (or microsimulation) tool 160, which receives as inputs turning percentages at intersections in the traffic link as well as the traffic volume predicted from the TPT 130. A turning percentage represents a percentage of a total incoming traffic volume that makes a specific turn in the traffic link (e.g., right turn or left turn or going straight at the intersections). The traffic microsimulation tool 160 computes an expected traffic volume or traffic speed in the traffic link if changes (e.g., road construction, a damaged traffic lane, broken traffic signal, etc.) are made within the traffic link.

The real-time traffic prediction system 100 incorporates real-time traffic data 105 into the TPT 130 which predicts traffic volume and speed (e.g., average speed) in a near future (e.g., 1 hour in advance). Real-time traffic data 105 includes, but is not limited to: the number of vehicles on the traffic link, average speed of the vehicles on the traffic link, etc. In one embodiment, the real-time traffic prediction system 100 receives the real-time traffic data via a wireless or wired communication network from a vehicle counter (e.g., Radar-based Field Vehicle Counter TC-RS50-D from SenSource, Inc.) that counts the number of moving and/or stationary vehicles on a portion of a road. In a further embodiment, the real-time traffic data may be an array format that includes multiple fields, i.e., one element in the array includes multiple fields (e.g., a road identification number, the number of vehicles on the road, a time and date when the vehicle counter counted the vehicles on the road, etc.).

Optionally, there is provided a module to run DEA (Data Expansion Algorithm). In one embodiment, there may be two separate entities to compute DEA: a real-time entity 120 and an offline entity 110. The offline entity 110 receives a collection of historical traffic data (e.g., last year's traffic data on the traffic link including, but not limited to, the number of incoming vehicles to the traffic link, the number of outgoing vehicles to each branch on the traffic link, etc.), e.g., from a database (not shown). The database may store the historical traffic data as a table (not shown) per traffic link. Upon receiving the historical traffic data (not shown), the offline entity 110 runs DEA and generates historical turning percentages 115 (i.e., proportions of turns taken by drivers in past, e.g., 25% drivers took right turn on the traffic link in the last year). The offline entity 110 may provide the generated historical turning percentages, e.g., in an array format in which an element having multiple fields. Each field in the array element may represent each turning percentage in the traffic link. Upon receiving the historical turning percentages 115 from the offline entity 110 and the real-time traffic data 105 from the vehicle counter (not shown), the real-time entity 120 runs DEA to compute likelihoods 125 that real-time incoming traffic to the traffic link are divided in the traffic link, i.e., probabilities of traffic splitting in the traffic link. For example, the real-time entity 120 sums traffic flows entering a node (intersection, for example) and then divides an outgoing traffic flow on each outgoing road link by the total traffic inflow at the node.

The real-time entity 120 may provide the computed likelihoods to the TPT 130, e.g., in an array format in which each element includes multiple fields. Each field in the array element may represent a probability that the real-time incoming traffic to the traffic link is divided at each branch in the traffic link. A co-pending and commonly owned U.S. Patent Application No. 2009-0099760, entitled "Method and system for expansion of real-time data on traffic networks," wholly incorporated by reference as if set forth herein, describes DEA in detail.

Upon receiving the real-time traffic data 105, e.g., from the vehicle counter, and the computed likelihood 125 from the real-time entity 120, the TPT 130 estimates a traffic speed (e.g., average speed of vehicles) and volume (i.e., the number of vehicles) in the traffic link over a pre-determined time period (e.g., 1, 10, 15, 30, 45 or 60 minutes). In one embodiment, the TPT 130 estimates the traffic speed and volume in real-time, e.g., less than 5 minute delay, over an entire prediction stage (e.g., These estimated traffic speed and volume are available at least 1 hour before being used by the turning percentage prediction module 140 and/or the traffic microsimulation tool 160). In a further embodiment, the TPT 130 generates the estimated traffic speed and volume in the traffic link, e.g., in an array format in which each element has multiple fields. These fields in the array element include, but are not limited to, an identification number or symbol of the traffic link, the estimated traffic speed of the traffic link, the estimated traffic volume of the traffic link, etc. The TPT 130 provides the estimated traffic speed 145 to the turning percentage prediction module 140. The TPT 130 provides the estimated traffic volume 150 to the traffic microsimulation tool 160. Commonly owned, co-pending U.S. Patent Application Publication No. 2008/0175161 A1 filed on Jan. 24, 2007, wholly incorporated by reference as if set forth herein, describes a TPT in detail. Commonly owned, co-pending U.S. Patent Application Publication No. 2010/0063715 A1 filed on Nov. 16, 2009, wholly incorporated by reference as if set forth herein, describes a TPT in detail.

The turning percentage prediction module 140 receives the estimated traffic speed 145, e.g., in the array format generated by the TPT 130 as described above. Optionally, the turning percentage prediction module 140 also receives the historical turning percentage 115, e.g., in the array format generated by the offline entity 110 as described above. The turning percentage prediction module 140 uses the estimated traffic speed and/or the historical turning percentages 115 to estimate each turning percentage of incoming traffic at each intersection for predicting a traffic condition in a future time horizon. In one embodiment, the turning percentage prediction module 140 may generate its own historical turning percentages directly from the traffic predictions, e.g., according to an equation (19) described below.

Figure 2:
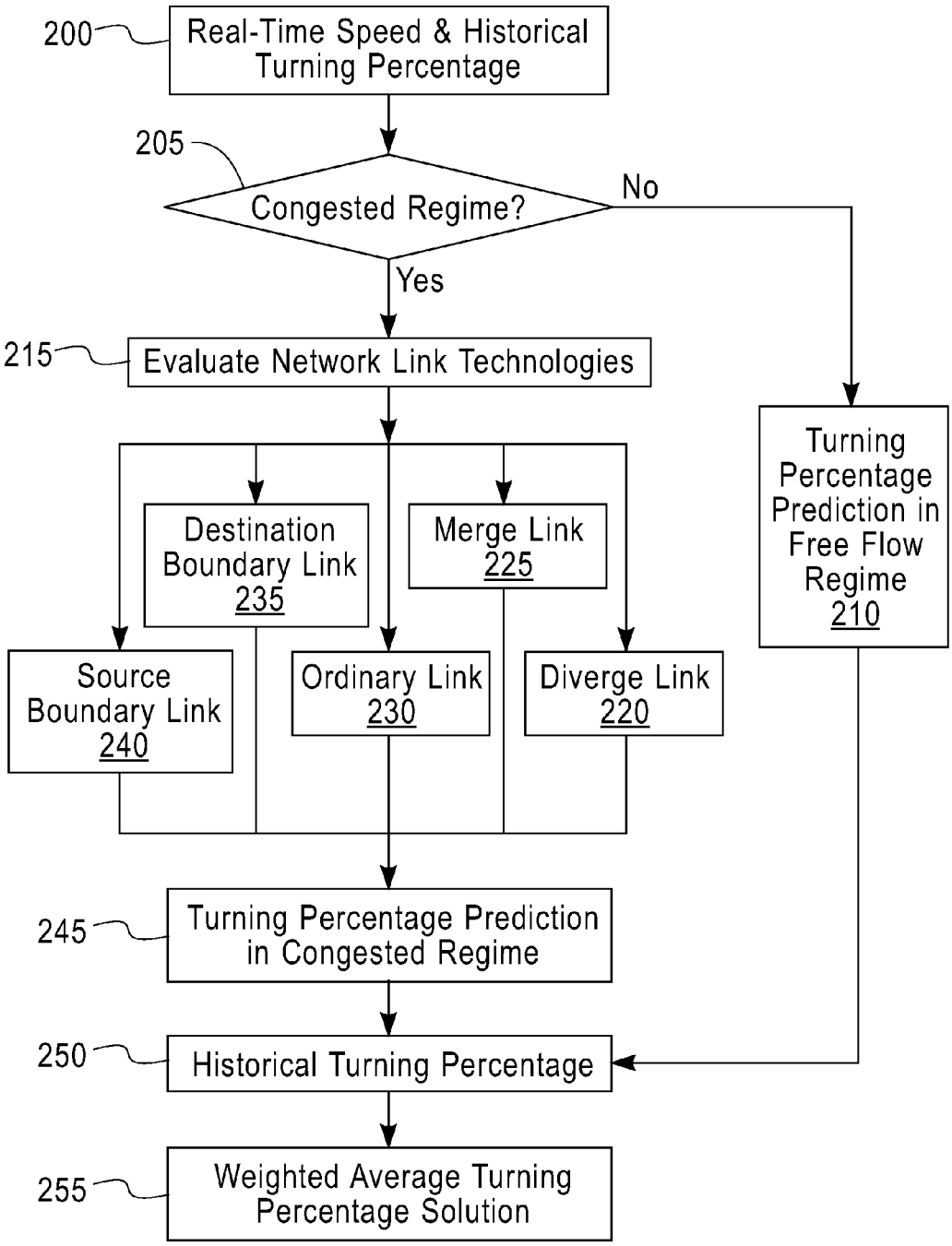
FIG. 2 is a flow chart that describes method steps performed by a turning percentage prediction module in one embodiment.

FIG. 2 is a flow chart that describes an operation of the turning percentage prediction module 140 in one embodiment. Let G(N,A) represents a graph representing a traffic network with a set of nodes ("N"), and a set of links ("A") connecting the nodes. A node in the graph represents an intersection. A link in the graph represents a traffic link (i.e., a portion of road connected to the intersection). Each link $(i,j) \in A$ is directed from a tail node $i \in N$, to a head node $j \in N$. Let $\Gamma(i):=\{j \in N | tail(i,j)=i\}$ represent a set of successor nodes to the node i and $\Gamma^{-1}(i):=\{j \in N | head(j,i)=i\}$ represent a set of predecessor nodes to the node i. Assume that a time period is discretized into a small interval t.

Notation t: An observation time interval $\Delta$: Length of the time interval $\sigma$: Length of a prediction stage $\tau$: Time index of the prediction stage $\gamma$: Prediction stage $v$: Link free-flow speed (i.e., traffic speed in the traffic link when there is no traffic congestion.)

$q_{max}$: Link maximum flow $w$: Link backward shockwave speed (i.e., traffic speed in the traffic link when there is a traffic jam in the traffic link)

$k_j$: Link jam density (i.e., the number of vehicles in a square feet when there is a traffic jam in the traffic link)

$i^d$: Downstream node of i for link $(i,i_l^d)$ $i^u$: Upstream node of i for link $(i^u, i)$ $d_{in}(t)$: Boundary input volume (i.e., number of vehicles entering the network) at time interval t $Q_{i,j}(t)$: The maximum number of vehicles that can flow into link (i,j) at time interval t $N_{i,j}(t)$: The maximum number of vehicles on link (i,j) at time interval t $\delta_{i,j}(t)$: A ratio of $w/v$ for link (i,j) at time interval t $n_{i,j}(t)$: An actual vehicle count on link (i,j) at time t $\tilde{n}_{i,j}(t)$: A predicted vehicle count on link (i,j) at time t $\zeta_{i,j}(t)$: A vehicle count prediction error for link (i,j) at time t, $\eta_{i,j}(t) \sim N(0,\psi)$ $\epsilon_{i,j}(t)$: A combined error terms in estimation of vehicle count on link (i,j) at time t $y_i(t)$: An inflow (i.e., the number of incoming vehicles) of node i for link (i,j) at time interval t $y_i^{i_l^u}$: An inflow of node i for link $(i_l^u,i)$ from upstream node $i_l^u$ for all node $l \epsilon \Gamma^{-1}(i)$ for merging links at time interval t $y_{i_l^d}^{i}(t)$: The inflow of node i for link $(i,i_l^d)$ to downstream node $i_l^d$ for all node $l \epsilon \Gamma(i)$ for diverging links at time interval t $\beta_{i,i_l^d}(t)$: An estimated vehicle diverging rate to link $(i,i_l^d)$ at time interval t.

At step 200 in FIG. 2, the turning percentage prediction module 140 receives the estimated traffic speed and/or the estimated traffic volume from the TPT 130. The turning percentage prediction module 140 may also receive the historical turn percentages from the offline entity 110. At step 205, the turning percentage prediction module 140 evaluates whether the traffic link is a congested regime or not. A congested regime refers to a traffic road that has a traffic volume larger than a threshold (e.g., 20 vehicles per lane within 4000 square foot of the traffic road). In one embodiment, there is provided a vehicle counter (e.g., Radar-based Field Vehicle Counter TC-RS50-D from SenSource, Inc.) (not shown). The vehicle counter, which may be attached on a metal frame above a traffic link, counts the number of moving and stationary vehicles in the traffic link, e.g., in a pre-determined time interval. If the count that counted by the vehicle counter is larger than a threshold, then the turning percentage prediction module 140 determines that that traffic link belongs to a congested regime.

At step 215, if the turning percentage prediction module 140 determines that the traffic link is a congested regime, the turning percentage prediction module 140 evaluates a link topology of the traffic link. A link topology includes, but is not limited to the following link categories: a diverge link shown in FIG. 8(*e*), a merge link shown in FIG. 8(*d*), an ordinary link shown in FIG. 8(*c*), a source boundary link shown in FIG. 8(*a*), and a destination boundary link shown in FIG. 8(*b*). In one embodiment, a traffic link does not simultaneously belong to two or more different categories. In other words, a traffic link belongs exclusively to only one category. For example, if a traffic link belongs to the ordinary link, that traffic link cannot belong to the source boundary link, the destination boundary link, the diverge link and the merge link. In one embodiment, the turning percentage prediction module 140 includes or is provided with an electronic map (not shown) that shows the traffic link to be evaluated in a detail (e.g., shows incoming branches and outgoing branches in the traffic link). According to the electronic map, if the traffic link has more than one incoming branch (e.g., an incoming branch 800 in FIG. 8(*d*)) and no outgoing branch (e.g., an outgoing branch 805 in FIG. 8(*e*)), the turning percentage prediction module 140 determines that the traffic link belongs to the merge link. According to the electronic map, if the traffic link has more than one outgoing branch but no incoming branch, the turning percentage prediction module 140 determines the traffic link belongs to the diverge link. In one embodiment, based on a traffic network topology, the turning percentage prediction module 140 determines whether a particular traffic link belongs to a particular traffic link, e.g., source boundary link, destination boundary link, etc. For example, if a particular traffic link includes a vehicle destination location (e.g., a parking lot, etc.), the turning percentage prediction module 140 determines that the particular traffic link is a destination boundary link (e.g., a destination boundary link shown in FIG. 8(*b*)).

Figure 7:
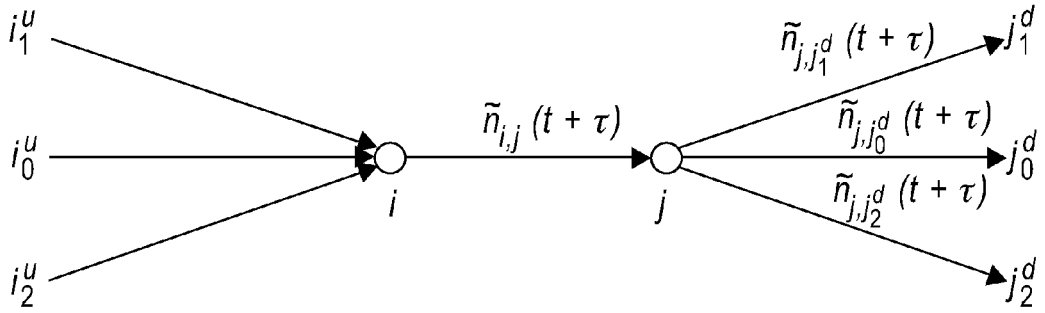
FIG. 7 illustrates an exemplary turning percentage in a congested regime in one embodiment.
Figure 8A:
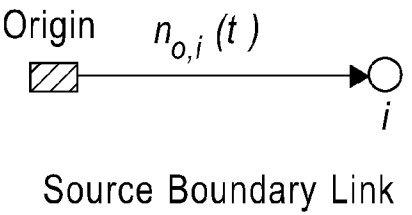
FIG. 8 illustrates classifications of traffic network topologies in one embodiment.
Figure 8B:
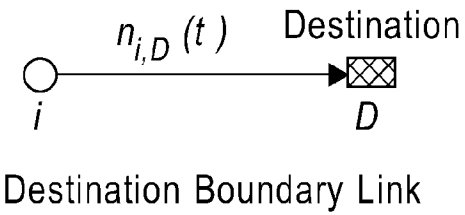
Figure 8C:
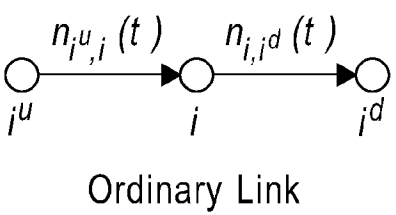
Figure 8D:
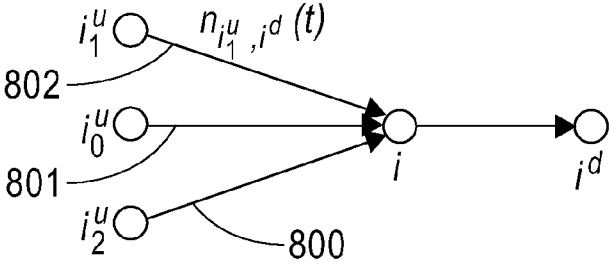
Figure 8E:
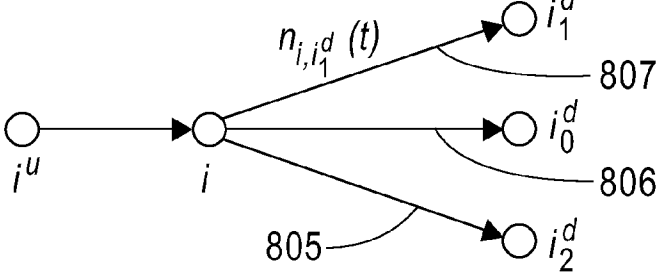

At steps 220-245, the turning percentage prediction module 140 estimates a turning percentage of the traffic link being evaluated according to the determined link topology. In one embodiment, if a traffic link $(j,j_l^d)$ is a congested regime, the turning percentage prediction module 140 computes a turning percentage, $\beta_{j,j_l^d}(t+\tau)$, on the traffic link $(j,j_l^d)$ by calculating $\beta_{j,j_l^d}(t+\tau)=y_{j_l^d}^{j}(t+\tau)/y_j(t+\tau)$, for $\forall l$ (i.e., for all traffic links), to account for traffic flows on upstream and downstream traffic links. For example, FIG. 7 illustrates an exemplary congested regime based on which the turning percentage prediction module 140 computes a turning percentage. In FIG. 7, $y_j(t+\tau)$ is equal to $\tilde{n}_{i,j}(t+\tau)$. $y_{j_1^d}^{j}(t+\tau)$ is equal to $\tilde{n}_{j,j_1^d}(t+\tau)$ is equal to $\tilde{n}_{j,j_0^d}(t+\tau)$. $y_{j_2^d}^{j}(t+\tau)$ is equal to $\tilde{n}_{j,j_2^d}(t+\tau)$. The turning percentage prediction module 140 computes a turning percentage for a traffic link $(j,j_l^d)$ by calculating $\beta_{j,j_l^d}(t+\tau)=y_{j_l^d}^{j}(t+\tau)/y_j(t+\tau)$. The turning percentage prediction module 140 computes turning percentages for other traffic links similarly. As described above, the turning percentage represents a percentage of a total incoming traffic volume that makes a specific turn in the traffic link (e.g., right turn or left turn or going straight at the intersections). Turning percentage is provided as an input to the microsimulation tool 160.

If a relationship between a traffic flow (q) and a traffic density (k) is of a form $$q=\min\{vk,q_{max},w(k_j-k)\}, \text{ for } 0\le k\le k_j \quad (1),$$

then a single traffic link can be approximated by a set of difference equations where current traffic conditions (e.g., real-time traffic data 105, estimated traffic speed 145, estimated traffic volume 150, and/or historical turning percentage 115) are updated at every time interval:

$$n_{i,j}(t+1)=n_{i,j}(t)+y_i(t)-y_j(t) \quad (2)$$

Since $\tilde{n}_{i,j}(t+1)=n_{i,j}(t+1)+\zeta_{i,j}(t+1)$, the equation (2) can be represented as $$\tilde{n}_{i,j}(t+1)=\tilde{n}_{i,j}(t)+y_i(t)-y_j(t)+\epsilon_{i,j}(t+1) \quad (3),$$

where $\epsilon_{i,j}(t+1)=\zeta_{i,j}(t+1)-\zeta_{i,j}(t)$ that combines errors in vehicle count estimations on a traffic link (i,j) at time t+1.

The following describes how the turning percentage prediction module 140 derives $y_{j_l^d}^{j}(t+\tau)$ and/or $y_j(t+\tau)$ for each link topology.

Source Boundary Link

A source boundary link is defined as a traffic link that enters vehicles into a traffic road. This source boundary link includes a location from where vehicles start a journey, for example, including, but not limited to: a public parking facility, parking lot, a city center, or neighborhood center, etc. FIG. 8(*a*) illustrates an exemplary source boundary link. In FIG. 8(*a*), $$\tilde{n}_{o,i}(t+\tau+1)=\tilde{n}_{o,i}(t+\tau)+y_o(t+\tau)-y_i(t+\tau)+\epsilon_{o,i}(t+\tau+1) \quad (4),$$

where $y_o(t)$ is a boundary input volume at time interval t+τ, given by $$y_o(t+\tau)=\min\{d_{in}(t+\tau),Q_{o,i}(t+\tau),(w_{o,i}(t+\tau))/v_{o,i}(t+\tau)))\times (N_{o,i}(t+\tau)-\tilde{n}_{o,i}(t+\tau))\} \quad (5)$$

Thus, $$y_i(t+\tau)=\tilde{n}_{o,i}(t+\tau+1)-\tilde{n}_{o,i}(t+\tau)-y_o(t+\tau)+\epsilon_{o,i}(t+\tau+1) \quad (6)$$

The turning percentage prediction module 140 computes a turning percentage $\beta_{o,i}$ in the exemplary source boundary link, e.g., by calculating $y_i(t+\tau)/y_o(t+\tau)$.

Destination Boundary Link

A destination boundary link is defined as a traffic link that absorbs vehicles out of a traffic road. This destination boundary link may include an actual destination location of a vehicle including, but not limited to: a parking facility, a parking lot, a working place, a neighborhood center, etc. FIG. 8(*b*) illustrates an exemplary destination boundary link. A destination node ("D" in FIG. 8(*b*)) in a destination boundary link is assumed to have infinite capacity, and allow infinite incoming traffic flows. Thus, $y_D(t+\tau)=n_{i,D}(t+\tau)$. In FIG. 8(*b*), $$y_i(t+\tau)=\tilde{n}_{i,D}(t+\tau+1)+\epsilon_{i,D}(t+\tau+1) \quad (7)$$

The turning percentage prediction module 140 computes a turning percentage $\beta_{i,D}$ in the exemplary destination boundary link, e.g., by calculating $y_D(t+\tau)/y_i(t+\tau)$.

Ordinary Link

An ordinary link is a traffic link that has one incoming and one outgoing branch. FIG. 8(*c*) illustrates an exemplary ordinary link. If $y_i(t+\tau)$, the inflow of node i at time interval t+τ, is known, $$y_{i^d}(t+\tau)=\tilde{n}_{i,i^D}(t+\tau)+y_i(t+\tau)-\tilde{n}_{i,i^d}(t+\tau+1)+\epsilon_{i,i^d}(t+\tau+1) \quad (8)$$

Otherwise, if $y_i(t+\tau)$, the inflow of node i at time interval t+τ, is unknown, $$y_i(t+\tau)=\min\{n\tilde{n}_{\mu,i}(t+\tau),Q_{i,i^d}(t+\tau),(w_{i,i^d}(t+\tau)/v_{i,i^d}(t+\tau))\times (N_{i,i^d}(t+\tau)-\tilde{n}_{i,i^d}(t+\tau))\} \quad (9)$$

Thus, $$y_{i^d}(t+\tau)=\tilde{n}_{i,i^d}(t+\tau)+y_i(t+\tau)-\tilde{n}_{i,i^d}(t+\tau1)+\epsilon_{i,i^d}(t+\tau+1) \quad (10)$$

The turning percentage prediction module 140 computes a turning percentage $\beta_{i,i^d}$ in the exemplary ordinary link, e.g., by calculating $y_{i^d}(t+\tau)/y_i(t+\tau)$.

Merge Link

A merge link is a traffic link that has more than one incoming branches. FIG. 8(*d*) illustrates an exemplary merge link that has three incoming branches 800-802.

In FIG. 8(*d*), if $y_i^{i_l^u}(t+\tau)$, $y_i^{i_0^u}(t+\tau)$, $y_i^{i_2^u}(t+\tau)$, the inflow of node i from upstream node $i_1^u$, $i_0^u$, $i_2^u$ at time interval t+τ, is known, $$y_{i^d}(t+\tau)=\tilde{n}_{i,i^d}(t+\tau)+\sum_{l\in\Gamma^{-1}(i)} y_i^{i_l^u}(t+\tau)-\tilde{n}_{i,i^d}(t+\tau+1)+\varepsilon_{i,i^d}(t+\tau+1) \quad (11)$$

Otherwise, if $y_i^{i_1^u}(t+\tau)$, $y_i^{i_0^u}(t+\tau)$, $y_i^{i_2^u}(t+\tau)$, the inflow of node i from upstream node $i_1^u$, $i_0^u$, $i_2^u$ at time interval t+τ, is unknown, $$y_i^{i_l^u}(t+\tau)=\min\left\{\begin{array}{l}\tilde{n}_{i_l^u,i}(t),\\ Q_{i_l^u,i}(t+\tau),\\ p_{i_l^u,i}(t+\tau)\times Q_{i,i^d}(t+\tau),\\ p_{i_l^u,i}(t+\tau)\times\left(w_{i,i^d}(t+\tau)/v_{i,i^d}(t+\tau)\right)\times\left(N_{i,i^d}(t+\tau)-\tilde{n}_{i,i^d}(t+\tau)\right)\end{array}\right\}, \quad (12)$$

for $\forall l\in\Gamma^{-1}(i)$, where $p_{i_l^u,i}(t+\tau)$ is a time dependent merging rate for link $(i_l^u,i)$ such that $$\sum_l p_{i_l^u,i}(t+\tau)=1.$$

Thus, $$y_{i^d}(t+\tau)=\tilde{n}_{i,i^d}(t+\tau)+\sum_{l\in\Gamma^{-1}(i)} y_i^{i_l^u}(t+\tau)-\tilde{n}_{i,i^d}(t+\tau+1)+\varepsilon_{i,i^d}(t+\tau+1). \quad (13)$$

The turning percentage prediction module 140 computes a turning percentage $\beta_{i,i^d}$ in the exemplary merge link, e.g., by calculating $$y_i^{i_l^d}(t+\tau)/\{y_i^{i_l^u}(t+\tau)+y_i^{i_0^u}(t+\tau)+y_i^{i_2^u}(t+\tau)\}. \quad (14)$$

Diverge Link

A diverge link is a traffic link that has more than one outgoing branches. FIG. 8(*e*) illustrates an exemplary diverge link that has three outgoing branches 805-807. In FIG. 8(*e*), if $y_i(t+\tau)$ is known, the inflow of node i to downstream node $i_l^d$ is $$y_{i_l^d}(t+\tau)=\beta_{i,i_l^d}(t+\tau)\times y_i(t+\tau),\ \text{for}\ \forall l \quad (15)$$

Otherwise, if $y_i(t+\tau)$ is unknown, the inflow of node i to downstream node $i_l^d$ for link (i, $i_l^d$) can be derived from the existing vehicles and outflow of this link:

$$y_{i_l^d}(t+\tau)=\tilde{n}_{i,i_l^d}(t+\tau+1)-\tilde{n}_{i,i_l^d}(t+\tau)+\epsilon_{i,i_l^d}(t\tau+1),\ \text{for}\ \forall l\in\Gamma(i) \quad (16)$$

And, $$y_i(t+\tau)=\sum_{l\in\Gamma(i)} y_{i_l^d}^i(t+\tau) \quad (17)$$

Since $$y_{i_l^d}^i(t+\tau)=\tilde{n}_{i,i_l^d}(t+\tau+1)-\tilde{n}_{i,i_l^d}(t+\tau)+y_{i_l^d}(t+\tau)+\varepsilon_{i,i_l^d}(t+\tau+1)=\beta_{i,i_l^d}(t+\tau)\times y_i(t+\tau) \quad (18)$$

So, $$\beta_{i,i_l^d}(t+\tau)=\frac{\tilde{n}_{i,i_l^d}(t+\tau+1)-\tilde{n}_{i,i_l^d}(t+\tau)+y_{i_l^d}(t+\tau)+\varepsilon_{i,i_l^d}(t+\tau+1)}{y_i(t+\tau)}, \quad (19)$$

for $\forall\, l\in\Gamma(i)$

Thus, turning percentage prediction module 140 computes a turning percentage $\beta_{i,i_l^d}(t+\tau)$ for every downstream node i of diverging link ($i^u$, i) at time interval t+τ according to the equation (19).

Returning to FIG. 2, at step 205, upon determining that the traffic link being evaluated is not a congested regime (e.g., the vehicle counter counts the number of vehicles in the same traffic link and the counts is less than a threshold), at step 210, the turning percentage prediction module 140 determines that the traffic link belongs to a free flow regime and estimates a turning percentage of the traffic link as described below.

Figure 6:
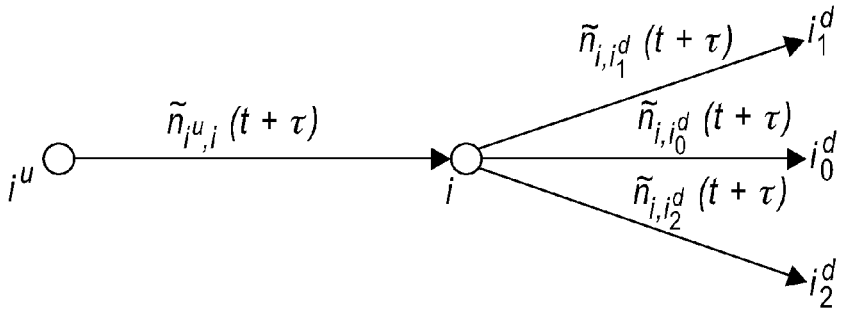
FIG. 6 illustrates an exemplary turning percentage in a free flow regime in one embodiment.

FIG. 6 illustrates an exemplary diverge link that belongs to a free flow regime in one embodiment. In this exemplary diverge link shown in FIG. 6, the turning percentage prediction module 140 estimates a turning percentage $\beta_{i,i_l^d}(t+\tau)$ on a traffic link $(i,i_l^d)$, e.g., by computing $\beta_{i,i_l^d}(t+\tau)=\tilde{n}_{i,i_l^d}(t+\tau)/\tilde{n}_{i^u,i}(t+\tau)$ for $\forall l \in \Gamma(i)$, where $$\sum_{all\ l} \beta_{i,i_l^d}(t+\tau) = 1.$$

In a free flow regime, a turning percentage in other link topologies (e.g., merge link, ordinary link, destination boundary link, and source boundary link) is equal to 1 since there is no congestion in the traffic link.

Returning to FIG. 2, at step 250, the turning percentage prediction module 140 computes a historical turning percentage that represents an average of prior turning percentages in the traffic link. Suppose that $\hat{\beta}_{l\times n}=\hat{\beta}_{i,i_l^d}{}^1(t+\tau), \hat{\beta}_{i,i_l^d}{}^2(t+\tau), \ldots \hat{\beta}_{i,i_l^d}{}^j(t+\tau), \ldots, \hat{\beta}_{i,i_l^d}{}^n(t+\tau)$, where $\hat{\beta}_{l\times n}$ is a row vector of an estimated vehicle diverging rate, and $\hat{\beta}_{i,i_l^d}{}^j(t+\tau)$ represents the estimated vehicle diverging rate to link $(i,i_l^d)$ at a time interval t at a day j. Further suppose that $C_{n\times n}=\mathrm{Cov}(\hat{\beta}_{i,i_l^d}{}^j(t+\tau))$ is a covariance matrix relating the quantities $\hat{\beta}_{i,i_l^d}(t+\tau)$ and that $P_{l\times n}$ is a design matrix, e.g., [1, 1, 1, . . . , 1]. Based on a linear regression method (e.g., Gaussian-Markov theorem), the turning percentage prediction module 140 computes a historical turning percentage $(\tilde{\beta}_{i,i_l^d}{}^{hist})$ with a minimum variance $$\left(\sigma_{\tilde{\beta}_{i,i_l^d}^{hist}}(t+\tau)\right) \text{ is:}$$

$$\tilde{\beta}_{i,i_l^d}^{hist}(t+\tau) = \sigma_{\tilde{\beta}_{i,i_l^d}^{hist}}(t+\tau) \times \left(P_{1\times n} \times C_{n\times n}^{-1} \times (\hat{\beta}_{1\times n})^T\right), \quad (20)$$

for $\forall\, l \in \Gamma(i)$, where $$\sigma_{\tilde{\beta}_{i,i_l^d}^{hist}}(t+\tau) = (P_{1\times n} \times C_{n\times n}^{-1} \times (P_{1\times n})^T)^{-1}.$$

In one embodiment, the historical turning percentage remains constant over a period of time (e.g., 1 day or 1 week). George H. Born, "Gauss-Markov Theorem," Dec. 8, 2004, http://ccar.colorado.edu/ASEN5070/handouts/Gauss_Markov__2004.pdf, whose contents are wholly incorporated by reference as if set forth herein, describes Gauss-Markov Theorem in detail.

Returning to FIG. 2, at step 255, the turning percentage prediction module 140 computes a weighted average turning percentage $(\hat{\beta}_{i,i_l^d}(t+\tau))$ based on the computed historical turning percentage $(\tilde{\beta}_{i,i_l^d}{}^{hist}(t))$ or the historical percentage provided from the offline entity 110 and a weight $(\alpha_{i,i_l^d}(t))$ assigned to every diverging link. The weight $(\alpha_{i,i_l^d}(t))$ may represent driver's reactions to a traffic flow pattern disturbance (e.g., a traffic accident), e.g., within a day. The turning percentage prediction module 140 computes a weighted average turning percentage $(\hat{\beta}_{i,i_l^d}(t+\tau))$, e.g., by calculating $$\hat{\beta}_{i,i_l^d}(t+\tau)=(1-\alpha_{i,i_l^d}(t+\tau))\times\tilde{\beta}_{i,i_l^d}{}^{hist}(t+\tau)+\alpha_{i,i_l^d}(t+\tau)\times \beta_{i,i_l^d}(t+\tau) \quad (20)$$

Returning to FIG. 1, the traffic microsimulation tool 160 receives turning percentages 155 (e.g., the turning percentage computed at step 245 in FIG. 2, or the turning percentage computed at step 210 in FIG. 2) from the turning percentage prediction module 140, e.g., in an array format in which an element having multiple fields. The fields in the array element may represent an identification number of a traffic link, a turning percentage in that traffic link, etc. The traffic microsimulation tool 160 also receives the estimated traffic volume 150 and/or estimated traffic speed from the TPT 130, e.g., in an array format in which an element having multiple fields. The fields in the array element may represent an identification number of a traffic link, the estimated traffic volume and the estimated traffic speed of the traffic link. The traffic microsimulation tool 160 runs a commercially available traffic simulation tool (e.g., CORSIM from University of Florida, VISSIM from PTV AG, Paramics from Quadstone® Paramics Ltd., etc.) with the received turning percentages 155 and the estimated traffic volume 140 and/or the estimated traffic speed to compute an expected traffic volume in the traffic link being evaluated upon an occurrence of an incident on the traffic link, e.g., by running one or more of the commercially available traffic simulation tool with the received turning percentages 155 and the estimated traffic volume 140 and/or the estimated traffic speed. There may be provided a central controller (e.g., a central controller 170 in FIG. 1) that detects an incident occurrence on the traffic link. An incident occurrence includes, but is not limited to: traffic light malfunction, road construction, traffic accident, etc. Upon detecting one or more of these incident occurrences (e.g., a red traffic signal does not change to a yellow traffic signal for more than 10 minutes), the central controller 170 sends a signal 175 indicating an incident occurrence to the traffic microsimulation tool 160.

In one embodiment, the traffic microsimulation tool 160 computes the expected traffic volume in the traffic link based on the historical turning percentage computed at step 250 in FIG. 2 and/or the weighted average turning percentage computed at step 255 in FIG. 2, e.g., by running the commercially available traffic simulation tool with computed historical turning percentage and/or the weighted average turning percentage and the estimated traffic volume 150 and/or the estimated traffic speed.

In one embodiment, the traffic microsimulation tool 160 receives the turning percentage 155 and the estimated traffic volume 150 in advance, e.g., 1 hour earlier from starting its computation for a traffic link. Thus, the traffic microsimulation tool 160 completes one or more simulations of possible traffic outcomes based on one or more scenarios. The simulations may project the impact on traffic conditions and the relative effectiveness of different possible actions on the traffic link being evaluated. Returning to FIG. 1, at step 165, upon the occurrence of an incident, the traffic microsimulation tool 160 recommends to a user an alternative traffic management strategy based on the estimated traffic volume 150 and/or the estimated traffic speed. The alternative traffic management strategy includes, but is not limited to: detouring traffic in the traffic link through another traffic link, adjusting a timing or length of a traffic signal in the traffic link, adjusting a speed limit in the traffic link, and adjusting a fare of the traffic link. For example, upon receiving the signal 175 indicating an occurrence of an incident (e.g., a long-term road construction, etc.), the real-time prediction system 100 may compare the expected traffic volume to an average traffic volume, which may be stored in a database (not shown). If the expected traffic volume is larger than the average traffic volume, the real-time prediction system 100 recommends an alternative traffic management strategy that can decrease the expected traffic volume, for example, increasing a fare of the traffic link.

Figure 4:
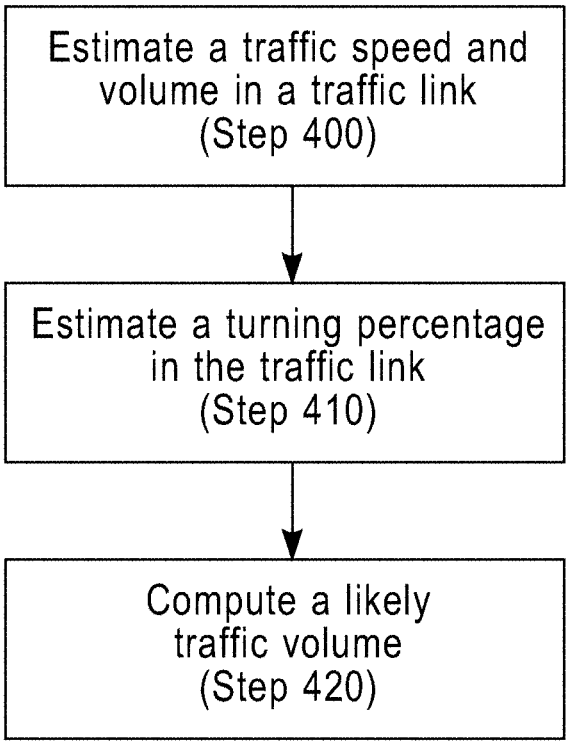
FIG. 4 is a flow chart that describes method steps performed by the real-time traffic prediction system in one embodiment.

FIG. 4 is a flow chart that summarizes the operation of the real-time prediction system 100 shown in FIG. 1 in one embodiment. At step 400, the TPT 130 estimates the traffic speed and volume in a traffic link in a near future (e.g., 1 hour in advance). At step 410, the turning percentage prediction module 140 determines a link topology of the traffic link and estimates a turning percentage in the traffic link according to the determined link topology based on the estimated traffic speed and volume. At step 420, upon an occurrence of an incident, the traffic microsimulation tool 160 computes an expected traffic volume in the traffic link based on the estimate turning percentage, the estimate traffic volume and/or the estimated traffic speed in the traffic link.

Figure 5:
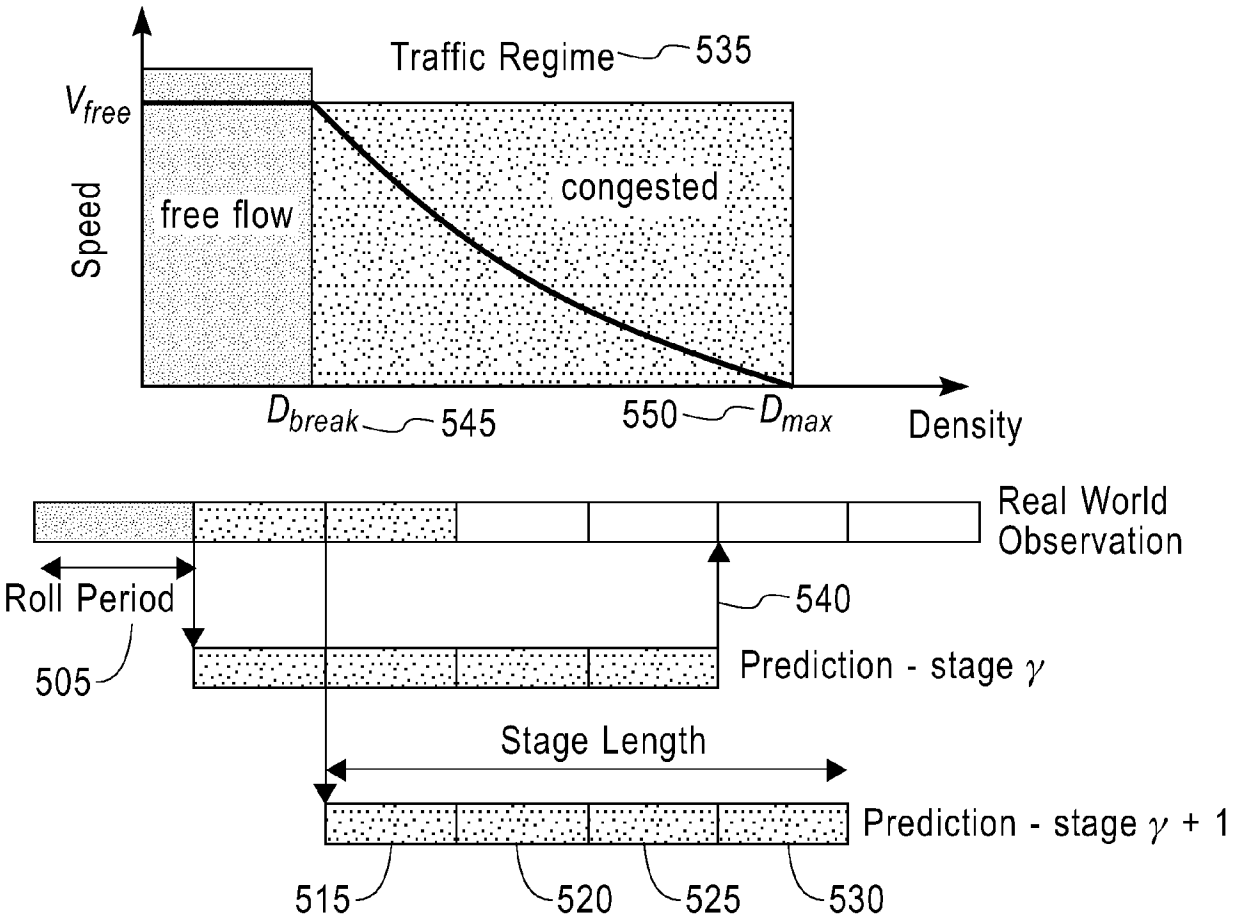
FIG. 5 illustrates a rolling horizon approach for real-time traffic prediction in one embodiment.

In one embodiment, the real-time traffic prediction system 100 operates according to a rolling horizon approach as shown in FIG. 5. The rolling horizon approach uses currently available information (e.g., turning percentages available 1 hour earlier than operating the traffic microsimulation tool 160 on a traffic link associated with the available turning percentages) and forecasts in a near future traffic (e.g., forecasting traffic condition in 1 hour advance). In this embodiment, according to the rolling horizon approach, the estimated traffic volume 150 and the computed turning percentages 155 are available for a next time period, whereas information beyond the period (e.g., turning percentages estimation in two hour advance) becomes available until a time window rolls. For example, FIG. 5 illustrates exemplary rolling horizon approach in one embodiment. The real-time traffic prediction system 100 may generate its output 540 (the expected traffic volume and/or alternative traffic management strategy) every rolling period 505. In FIG. 8, the real-time prediction system 100 may need real-time traffic data 105 every rolling period. In this embodiment, the real-time traffic prediction system 100 may operate, for example, in four steps (a first step 515—running the TPT 130; a second step 520—running the turning percentage prediction module 140; a third step 525—running the traffic microsimulation tool 160; a fourth step 530—recommending an alternative traffic management strategy). These steps may be pipelined, i.e., completion of each step takes a same time and is synchronized with a signal (e.g., clock signal) (not shown). One set of these four steps is called a stage. The clock period needs to be long enough (e.g., 20 minutes) to ensure that the real-time prediction system 100 can adequately account for unpredicted events in real-time traffic conditions in subsequent stages. The central controller 170 may use diverse measures to detect unpredicted events or incidents, for example, by observing traffic speed, traffic volume and/or traffic density against an average of historical traffic speed, traffic volume and traffic density provided that the real-time prediction system 100 reaches its equilibrium (i.e., inputs to every step is available at every rolling period, and outputs from every step is available at every rolling period).

A graph 535 in FIG. 5 depicts the rolling horizon approach for the real-time traffic prediction system 100 in response to different traffic regimes (e.g., free flow regime, congested regime). The graph 535 shows the threshold (e.g., $D_{break}$ 545) to distinguish the free flow regime over the congested regime. Once the real-time traffic data 105 become available, the real-time prediction system 100 computes a function to determine a traffic density of a traffic link being evaluated, where $D_{break}$ 545 is a regime breakpoint density, $D_{max}$ 550 is a maximum traffic jam density, $\alpha$ is a power term. The function (V(t)=G(D(t))) can be formulated as $$G(D(t)) = \begin{cases} V_{free}, & D(t) \in [0, D_{break}] \\ V_{free} \times \left(1 - \frac{D(t)}{D_{max}}\right)^{\alpha}, & D(t) \in (D_{break}, D_{max}] \end{cases} \quad (21)$$

Outputs of the function (21) is a predicted traffic volume ($\tilde{n}(t+\tau)/\Delta$) in the traffic link and a predicted traffic speed ($\tilde{v}(t+\tau)$) in the traffic link in a subsequent rolling period, where $\Delta$ is the length of the rolling period. The corresponding traffic link density and shockwave speed w can be derived as $D(t)=G^{-1}(V(t))$ and $$w(t+\tau) = \frac{(\tilde{n}(t+\tau) - \tilde{n}(t+\tau-1))/\Delta}{D(t+\tau) - D(t+\tau-1)},$$

respectively.

In one embodiment, the real-time prediction system 100 does not use an origin-destination matrix (not shown) that represents every traffic link with its origin and its destination. The real-time prediction system 100 reduces computation times compared to traditional traffic prediction systems and reduces resource requires (e.g., memory storage) because data (e.g., computed turning percentage 155, real-time traffic data 105, estimated traffic speed and volume) are not stored in any a memory or storage device (not shown) but directly provided from its generating component (i.e., a component generating the data; e.g., TPT 130) to its receiving component (i.e., a component receiving the data; e.g., the turning percentage prediction module 140), e.g., via a wired or wireless communication link (e.g., a communication link 145).

Figure 3:
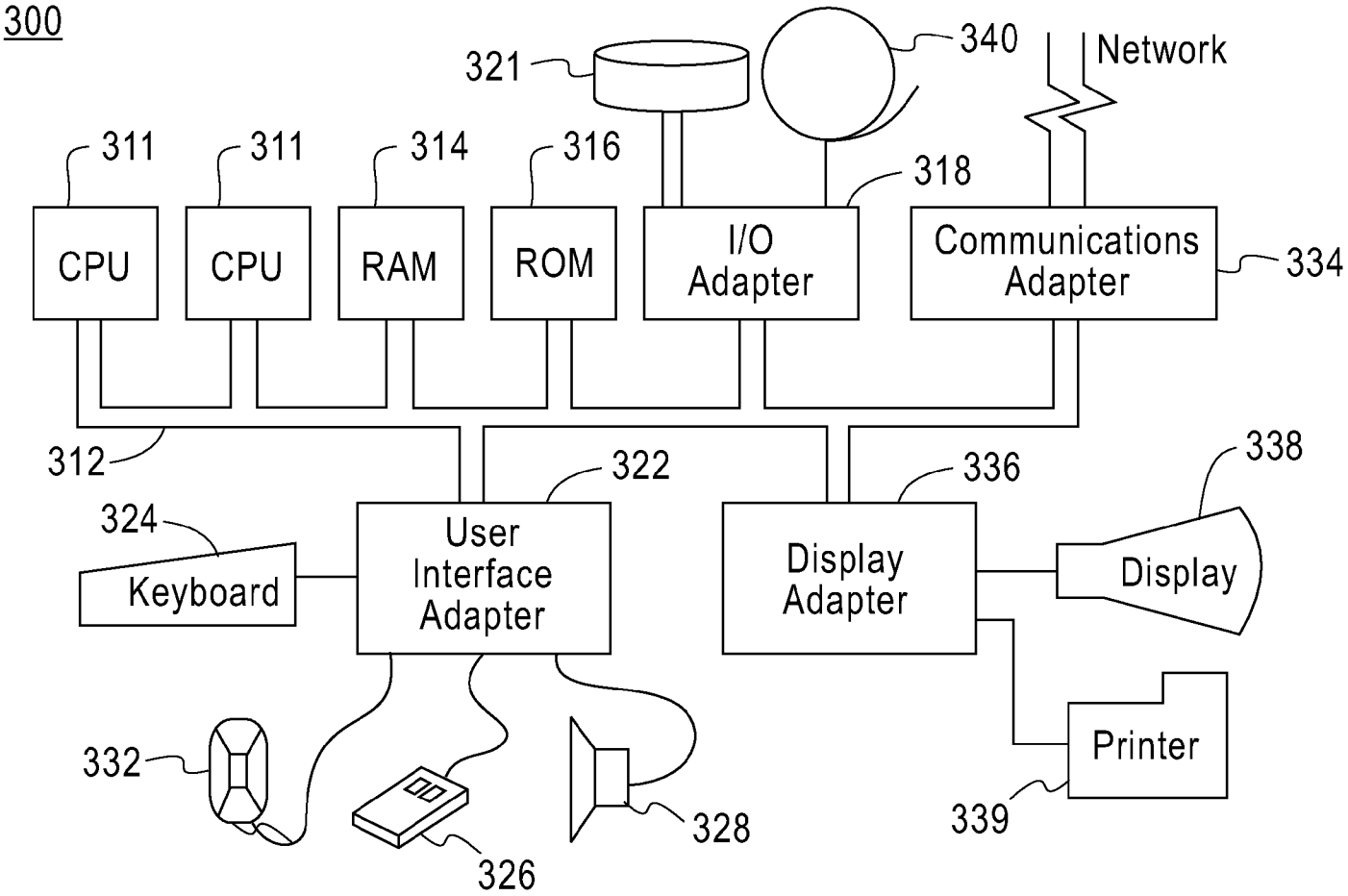
FIG. 3 illustrates an exemplary hardware configuration to implement the real-time traffic prediction system illustrated in FIG. 1.

FIG. 3 illustrates an exemplary hardware configuration of a computing system 200 running and/or implementing the real-time traffic prediction system 100 shown in FIG. 1. The hardware configuration preferably has at least one processor or central processing unit (CPU) 311. The CPUs 311 are interconnected via a system bus 312 to a random access memory (RAM) 314, read-only memory (ROM) 316, input/output (I/O) adapter 318 (for connecting peripheral devices such as disk units 321 and tape drives 340 to the bus 312), user interface adapter 322 (for connecting a keyboard 324, mouse 326, speaker 328, microphone 332, and/or other user interface device to the bus 312), a communication adapter 334 for connecting the system 300 to a data processing network, the Internet, an Intranet, a local area network (LAN), etc., and a display adapter 336 for connecting the bus 312 to a display device 338 and/or printer 339 (e.g., a digital printer of the like).

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with a system, apparatus, or device running an instruction.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with a system, apparatus, or device running an instruction.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may run entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which run via the processor of the computer or other programmable data processing apparatus, create means for implementing the functions/acts specified in the flowchart and/or block diagram block or blocks. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which run on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more operable instructions for implementing the specified logical function(s). It should also be noted that, in some alternative implementations, the functions noted in the block may occur out of the order noted in the figures. For example, two blocks shown in succession may, in fact, be run substantially concurrently, or the blocks may sometimes be run in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A system for forecasting a vehicle traffic condition in a near future, the system comprising:

a traffic prediction tool for estimating traffic data including: a traffic speed and volume in a traffic link, the traffic link referring to a portion of a traffic road where the traffic prediction tool is installed;

a turning percentage prediction module for receiving the estimated traffic data and estimating a weighted average turning percentage in the traffic link based on the estimated traffic data by calculating a first multiplication of a weight assigned to each diverging link and a historical turning percentage representing prior turning percentage of the each diverging link, a second multiplication of the weight and a vehicle diverging rate to the each diverging link during a time interval, and an addition of the first multiplication and the second multiplication; and a simulation tool for computing, based on the estimated turning percentage and the estimated traffic data, an expected traffic volume in the traffic link, wherein the traffic prediction tool, the turning percentage prediction module and the simulation tool are pipelined so that the traffic prediction tool, the turning percentage prediction module and the simulation tool finish respective operations at a same time by being synchronized according to a signal, and a plurality of stages, each stage running in parallel, the each stage corresponding to the traffic prediction tool, the turning percentage prediction tool and the simulation tool, wherein one or more of the traffic prediction tool, the turning percentage prediction module and simulation tool is implemented in a computing system that comprises at least one processor and at least one memory device connected to the processor.

2. The system according to claim 1, wherein the turning percentage prediction module performs steps of:

evaluating whether the traffic link is a congested regime, the congested regime having a traffic volume larger than a threshold;

determining a link topology of the traffic link in response to determining that the traffic link is a congested regime, the link topology being one of: a diverge link, a merge link, an ordinary link, a source boundary link and a destination boundary link; and computing the estimated weighted average turning percentage according to the determined link topology.

3. The system according to claim 2, wherein the turning percentage prediction module further performs steps of:

computing the historical turning percentage of the traffic link, the historical turning percentage representing an average of prior turning percentages in the traffic link.

4. The system according to claim 3, wherein the simulation tool computes the expected traffic volume in the traffic link based on one or more of: the computed historical turning percentage of the traffic link and the estimated weighted average turning percentage.

5. The system according to claim 2, wherein the turning percentage prediction module further performs a step of:

computing the estimated weighted average turning percentage of the traffic link in a free flow regime in response to determining that the traffic link is not a congested regime, the free flow regime having a traffic volume less than a threshold.

6. The system according to claim 1, wherein the simulation tool recommends to a user an alternative traffic management strategy based on the computed expected traffic volume and an incident occurrence.

7. The system according to claim 6, wherein the alternative traffic management strategy includes one or more of: detouring traffic in the traffic link through another traffic link, adjusting a traffic signal in the traffic link, adjusting a speed limit in the traffic link, and adjusting a fare of the traffic link.

8. A method for forecasting a vehicle traffic condition in a near future, the method comprising:

estimating traffic data including: a traffic speed and volume in a traffic link, the traffic link referring to a portion of a traffic road where the traffic prediction tool is installed;

estimating a weighted average turning percentage in the traffic link based on the estimated traffic data by calculating a first multiplication of a weight assigned to each diverging link and a historical turning percentage representing prior turning percentage of the each diverging link, a second multiplication of the weight and a vehicle diverging rate to the each diverging link during a time interval, and an addition of the first multiplication and the second multiplication; and computing, based on the estimated turning percentage and the estimated traffic data, an expected traffic volume in the traffic link, wherein the traffic prediction tool, the turning percentage prediction module and the simulation tool are pipelined so that the traffic prediction tool, the turning percentage prediction module and the simulation tool finish respective operations at a same time by being synchronized according to a signal, and a plurality of stages, each stage running in parallel, the each stage corresponding to the traffic prediction tool, the turning percentage prediction tool and the simulation tool, wherein a computing system that comprises at least one processor and at least one memory device connected to the processor performs the estimating the traffic data, the estimating the turning percentage, and the computing the expected traffic volume.

9. The method according to claim 8, wherein the estimating the weighted average turning percentage comprises steps of:

evaluating whether the traffic link is a congested regime, the congested regime having a traffic volume larger than a threshold;

determining a link topology of the traffic link in response to determining that the traffic link is a congested regime, the link topology being one of: a diverge link, a merge link, an ordinary link, a source boundary link and a destination boundary link; and computing the estimated weighted average turning percentage according to the determined link topology.

10. The method according to claim 9, wherein the estimating the weighted average turning percentage further comprises steps of:

computing the historical turning percentage of the traffic link, the historical turning percentage representing an average of prior turning percentages in the traffic link.

11. The method according to claim 10, further comprising:

computing the expected traffic volume in the traffic link based on one or more of: the computed historical turning percentage of the traffic link and the estimated weighted average turning percentage.

12. The method according to claim 9, further comprises:

computing the estimated weighted average turning percentage of the traffic link in a free flow regime in response to determining that the traffic link is not a congested regime, the free flow regime having a traffic volume less than a threshold.

13. The method according to claim 11, further comprising:

recommending to a user an alternative traffic management strategy based on the computed expected traffic volume and the incident occurrence.

14. The method according to claim 13, wherein the alternative traffic management strategy includes one or more of: detouring traffic in the traffic link through another traffic link, adjusting a traffic signal in the traffic link, adjusting a speed limit in the traffic link, and adjusting a fare of the traffic link.

15. A computer program product for forecasting a vehicle traffic condition in a near future, the computer program product comprising a non-transitory storage medium readable by a processing circuit and storing instructions run by the processing circuit for performing a method, the method comprising:

estimating traffic data including: a traffic speed and volume in a traffic link, the traffic link referring to a portion of a traffic road where the traffic prediction tool is installed;

estimating a weighted average turning percentage in the traffic link based on the estimated traffic data by calculating a first multiplication of a weight assigned to each diverging link and a historical turning percentage representing prior turning percentage of the each diverging link, a second multiplication of the weight and a vehicle diverging rate to the each diverging link during a time interval, and an addition of the first multiplication and the second multiplication; and computing, based on the estimated turning percentage and the estimated traffic data, an expected traffic volume in the traffic link, wherein the traffic prediction tool, the turning percentage prediction module and the simulation tool are pipelined so that the traffic prediction tool, the turning percentage prediction module and the simulation tool finish respective operations at a same time by being synchronized according to a signal, and a plurality of stages, each stage running in parallel, the each stage corresponding to the estimating the traffic data, the estimating the weighted average turning percentage and the computing.

16. The computer program product according to claim 15, wherein the estimating the turning percentage comprises steps of:

evaluating whether the traffic link is a congested regime, the congested regime having a traffic volume larger than a threshold;

determining a link topology of the traffic link in response to determining that the traffic link is a congested regime, the link topology being one of: a diverge link, a merge link, an ordinary link, a source boundary link and a destination boundary link; and computing the estimated weighted average turning percentage according to the determined link topology.

17. The computer program product according to claim 16, wherein the estimating the turning percentage further comprises steps of:

computing the historical turning percentage of the traffic link, the historical turning percentage representing an average of prior turning percentages in the traffic link.

18. The computer program product according to claim 17, wherein the method further comprises:

computing the expected traffic volume in the traffic link based on one or more of: the computed historical turning percentage of the traffic link and the estimated weighted average turning percentage.

19. The computer program product according to claim 16, wherein the method further comprises:

computing the estimated weighted average turning percentage of the traffic link in a free flow regime in response to determining that the traffic link is not a congested regime, the free flow regime having a traffic volume less than a threshold.

20. The computer program product according to claim 15, wherein the method further comprises:

recommending to a user an alternative traffic management strategy based on the computed expected traffic volume and an incident occurrence.

21. The computer program product according to claim 20, wherein the alternative traffic management strategy includes one or more of: detouring traffic in the traffic link through another traffic link, adjusting a traffic signal in the traffic link, adjusting a speed limit in the traffic link, and adjusting a fare of the traffic link.

* * * * *